United States Patent [19]

Dickson

[11] Patent Number: 4,984,529

[45] Date of Patent: Jan. 15, 1991

[54] EDUCATIONAL METHOD, REUSABLE EDUCATIONAL BOOKMARKING DEVICE AND WRITING INSTRUMENT CLIP

[76] Inventor: Sandra L. Dickson, P.O. Box 1176, Newnan, Ga. 30263

[21] Appl. No.: 372,603

[22] Filed: Jun. 28, 1989

[51] Int. Cl.[5] ..... B42D 9/00

[52] U.S. Cl. ..... 116/234

[58] Field of Search ..... 116/234–240; 281/42; D19/34; 24/10 R–11 PP, 545, 555, 561, 563; 40/352, 666; 156/73.1

[56] References Cited

U.S. PATENT DOCUMENTS

| | | | |
|---|---|---|---|
| 2,300,216 | 10/1942 | Grodsky et al. | 116/237 |
| 2,510,053 | 6/1950 | Pfeiffer | 281/42 |
| 2,590,615 | 3/1952 | Heckendorn | 116/234 |
| 3,324,823 | 6/1967 | Peters | 116/234 |
| 3,552,047 | 1/1971 | Dalziel | 40/641 |
| 3,765,973 | 10/1973 | Kramer | 156/73.1 |
| 4,162,800 | 7/1979 | Gonot, Jr. | 281/42 |
| 4,449,310 | 5/1984 | Kline | 40/658 |
| 4,729,496 | 3/1988 | Davidson | 222/215 |
| 4,798,639 | 1/1989 | Yamaguchi | 156/73.1 |

FOREIGN PATENT DOCUMENTS

| | | | |
|---|---|---|---|
| 40814 | 9/1887 | Fed. Rep. of Germany | 24/11 PP |
| 24895 | 10/1910 | United Kingdom | 24/11 PP |

*Primary Examiner*—William A. Cuchlinski, Jr.
*Assistant Examiner*—W. Morris Worth
*Attorney, Agent, or Firm*—Ronald P. Kananen

[57] ABSTRACT

There are disclosed an educational method and bookmarker device which includes permanent indicia that facilitate recording and compiling of words and notes from text material being read. The bookmarker device includes a surface upon which information can be recorded on and removed therefrom. Included is a writing instrument which is removably retained in a novel writing instrument clip attached to the bookmarker device.

6 Claims, 2 Drawing Sheets

EDUCATIONAL METHOD, REUSABLE EDUCATIONAL BOOKMARKING DEVICE AND WRITING INSTRUMENT CLIP

BACKGROUND OF THE INVENTION

The present invention relates generally to an educational device and method. More particularly, it relates to an educational bookmarker device and method of learning as well as to an improved writing instrument clip.

While reading or studying, it is often desirable to easily save or record, certain words, phrases or other information for future use and study. This can be done by the reader highlighting text material with an appropriate marker and/or reducing to writing the desired text information to be saved on a separate sheet of paper. There are a number of disadvantages associated with the foregoing approaches, for example, highlighting has a disadvantage of permanently marking the book.

Moreover, with children it is highly desirable to improve their reading skills by organizing the manner by which they learn new words and study text. In this regard, it is useful to have the recording medium close at hand and easily useable in conjunction with the book that is to be read. Further, it is highly advantageous to provide quick reference to any material which has been recorded as well as have the ability to reuse the recording medium. Accordingly, there has been a longstanding need in the educational field for providing such features.

SUMMARY OF THE INVENTION

The present invention improves upon known educational devices for use with studying text. In this regard, the present invention is directed toward an educational device in the form of a reusable bookmarker. According to the invention provision is made for a thin sheet material having a predetermined size which includes indicia on at least one recording surface thereof. The indicia facilitate organization of information to be recorded from the text. The sheet material surface is constructed so that its recording surface can have information easily recorded and removed therefrom for convenient reuse.

In an illustrated embodiment, there is provided an educational bookmarker what is sized to serve as a removable/replaceable page locator as well as have indicia thereon which facilitate recording and compilation of words and/or phrases from the text of the book being read.

In another illustrated embodiment, provision is made for a novel clip to be attached to the sheet material for removably retaining a writing instrument. The clip of the present invention is provided with a first portion including a plurality of energy deflectors which facilitate ultrasonic welding of the clip to plastic sheet material. A second portion integral with the first portion is constructed to removably retain a writing instrument therein.

In another illustrated embodiment, provision is made for an educational method. The steps include providing a bookmarker device which is sized to serve as a removable/replaceable page locator. Printed indicia are provided on the bookmarker device which facilitate recording and compiling words and notes from the text being read. Provision is made to have a bookmarker device with a recording surface upon which indicia can be recorded on and removed therefrom. A writing instrument is provided for recording indicia on the recording surface and the bookmarker device is provided with a clip for releasably retaining therein the writing instrument.

Among the other objects and features of the present invention are the provision of an improved educational bookmarker device; the provision of an educational bookmarker device of the above type which has a surface upon which indicia may be recorded thereon and erased therefrom; the provision of an educational bookmarker device of the type noted which has attached thereto a clip for removably retaining a writing instrument used for recording information on the recording surface; the provision of an educational bookmarker device which includes in combination therewith a writing instrument for recording information on the recording surface; the provision for an educational bookmarker device wherein the permanent indicia include a plurality of lines for allowing sequential recordation of words thereon; the provision of an educational bookmarker device which is sized so as to serve as a removable/replaceable page locator for books; the provision of an educational bookmarker device of the type noted wherein the permanent indicia thereon facilitate recording and compilation of words and/or phrases from the text being read; the provision of an improved writing instrument retaining clip which has one portion including a plurality of energy deflectors on a surface thereof for facilitating securement to the bookmarker device and a second portion for removably retaining a writing instrument therein; and, the provision of an improved educational method.

Still other objects and further scope of applicability of the present invention will become apparent from the detailed description to follow when taken in conjunction with the accompanying drawings in which like parts are designated by like reference numerals throughout the several views.

DETAILED DESCRIPTION

Figure 1:
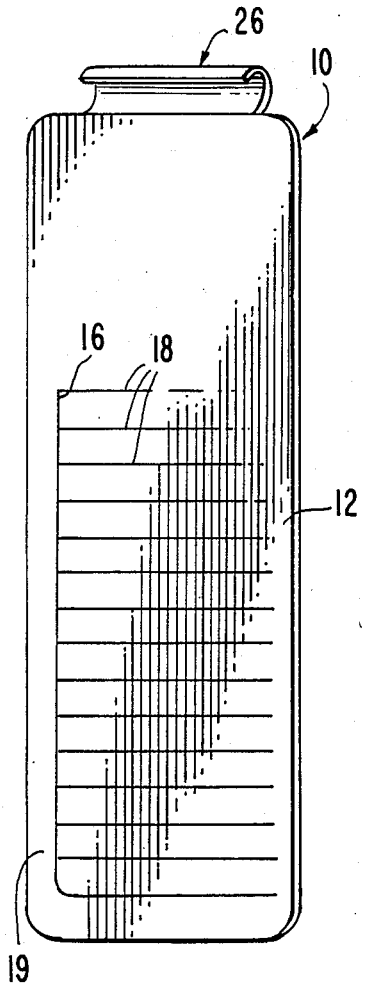
FIG. 1 is a perspective view of a preferred embodiment of an educational bookmarker device of the present invention.

In accordance with the present invention, there is provided a reusable educational bookmarker device 10. Initial reference is made to FIGS. 1–3 wherein one embodiment of the bookmarker device 10 is illustrated as being a generally planar and elongated sheet assembly 12 having recording surfaces 14 on opposite sides thereof. The sheet assembly 12 can be produced in a plurality of sizes and shapes and is thin enough to be easily slipped between and removed from pages of, for example, a book. In this way it serves as a removable/replaceable page locator. Examples of such sizes are 3¾ inch×6½ inch; 2¼ inch×7 inch; and 8½ inch×11 inch. The recording surfaces 14 include permanent indicia 16 thereon which provide information that facilitates the recording and compilation of words and/or notes that a reader selects to reduce to writing while reading a book. The invention contemplates several approaches for providing the permanent indicia. The permanent indicia 16 in this embodiment can be done by silk screening and includes a plurality of printed lines 18 which are arranged, as shown in the drawings, to facilitate the tabulation of words or other information desired to be recorded.

The sheet assembly 12 in this embodiment is defined by a polyvinyl plastic, material overlaminated with a suitable clear vinyl and is manufactured so that the recording surfaces 14 have a smooth and glossy finish. Such a surface finish facilitates the writing and subsequent erasing therefrom of indicia recorded with a suitable writing instrument 20. The writing instrument envisioned for use with the bookmarker device 10 includes a writing medium, such as a water-soluble marking fluid to enhance removal of the indicia with a water solution. Examples of writing instruments of the above type for use on conjunction with the sheet assembly 12 are commercially available from Sanford Corp. of Illinois. Non-water soluble writing fluids could be removed by applying a suitable cleaning solution.

Referring back to the sheet assembly 12, while the present embodiment discloses that the sheet assembly 12 is made of a polyvinyl laminate material, the present invention contemplates that it can be manufactured from a variety of materials including but not limited to LUCITE TM, PLEXIGLAS TM and glass. An example of another construction, which is not shown, is a composite laminate structure including a rectangular paperboard core member (not shown) disposed between opposing laminated coversheets (not shown) of a transparent polyester material, such as MYLAR TM. The paperboard core would have indicia printed thereon as noted above for educational purposes. The transparent polyester coversheets not only protect the paperboard core from normal wear and tear thereby enhancing its useful life, but also allows reuse. In this latter regard, the coversheets are intended to permit recording and erasing of indicia written thereon by suitable writing mediums which can be water-soluble.

The recording surfaces 14 include other indicia including directions for the use of the bookmarker device 10 and information which would enhance educational uses of the bookmarker. In one embodiment, the recording surface 14 is provided with a non-erasable portion 22 which is made of a thin layer of material 24, such as polyvinyl plastic having a matt-finish. Information can be permanently recorded on the portion 22.

Figure 2:
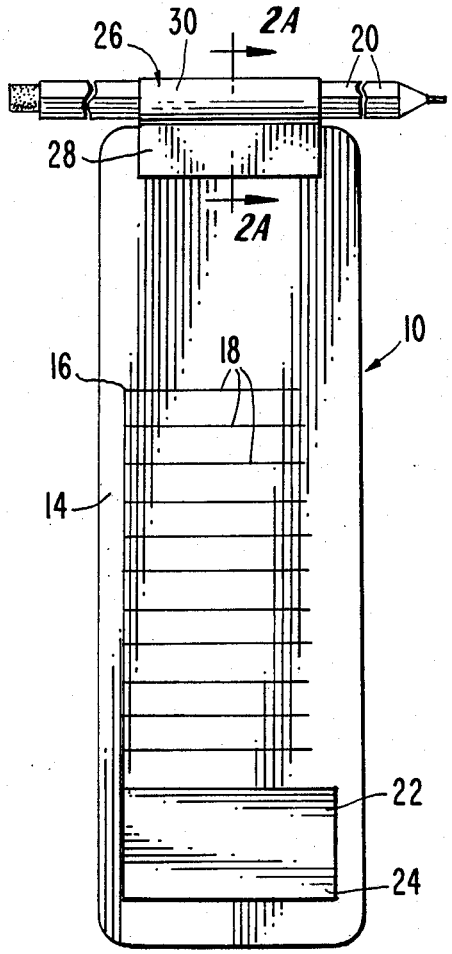
FIG. 2 is a rear view of the preferred embodiment of the educational bookmarker device.
Figure 3:
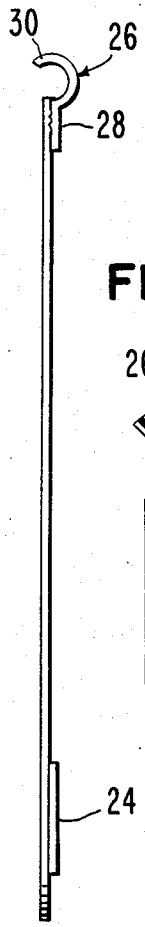
FIG. 3 is an end view of an educational bookmarker device.
Figure 2A:
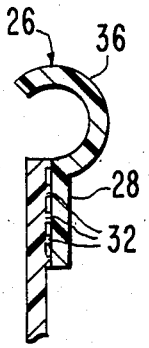
FIG. 2A is an enlarged cross-sectional view taken along section line 2A—2A in FIG. 2.
Figure 4:
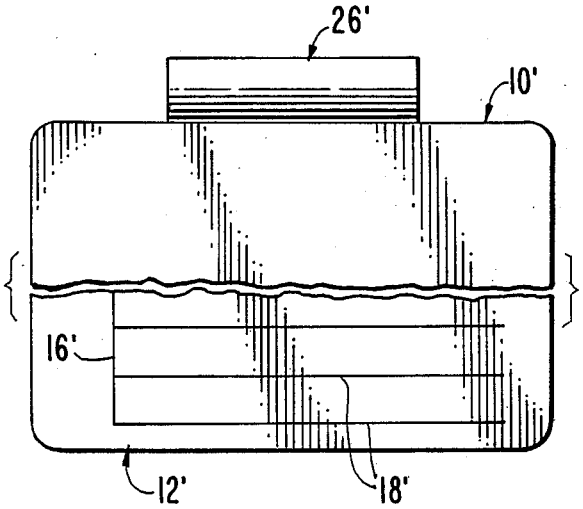
FIG. 4 is an elevational view of an alternate embodiment present invention.

To provide a complete educational system for use by a reader, the bookmarker device 10 also includes a novel and improved writing instrument retaining clip 26. The clip 26 in one embodiment has a configuration, such as best seen in FIGS. 1–3. The clip 26 includes a generally planar, upright attaching portion 28 being integrally connected to an elongated retaining portion 30 having a generally C-shaped cross-section which allows a snap-type of the writing instrument. The attaching portion 28 is provided with a plurality of longitudinally extending and spaced apart energy deflectors 32 of the type which facilitate ultrasonic welding of the retaining clip 26 to the plastic sheet assembly 12. Alternatively, the present invention contemplates that the clip 26 can be adhesively bonded to the sheet assembly 12. The writing instrument retaining portion 30 is arranged and configured so as to yieldably retain therein an elongated portion of the writing instrument 20. Of course, other sizes and configurations of the clip 26 are contemplated by the present invention. For instance, the shape of the retaining portion 30 need not be generally C-shaped.

Figure 5:
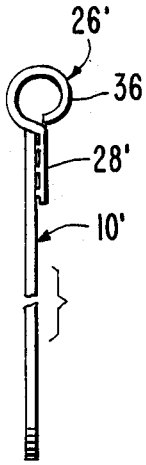
FIG. 5 is an end view of the alternate embodiment of FIG. 4.

Alternatively, a second embodiment of the clip 26' is contemplated to be attached to a bookmarker device 10'. The alternative embodiment is like the clip 26, but with an overlapping curled portion 34 (FIG. 5). The overlapping curled portion 36 would expand radially upon longitudinal insertion of the writing instrument 20 therein so as to yieldably retain the latter. Both the clips 26 and 26' can be made from a variety of plastic materials which preferably facilitate ultrasonic welding and the releasable snap-fit retention of the writing instrument 20. For instance, these materials include but are not limited to rigid polyvinyl.

While the present invention contemplates that the clip can be attached to the marginal edge of the educational bookmarking device 10, such placement need not be the case. Also the present invention contemplates having the writing instrument clips attached to other objects, such as small plastic carrying cards.

Figure 7:
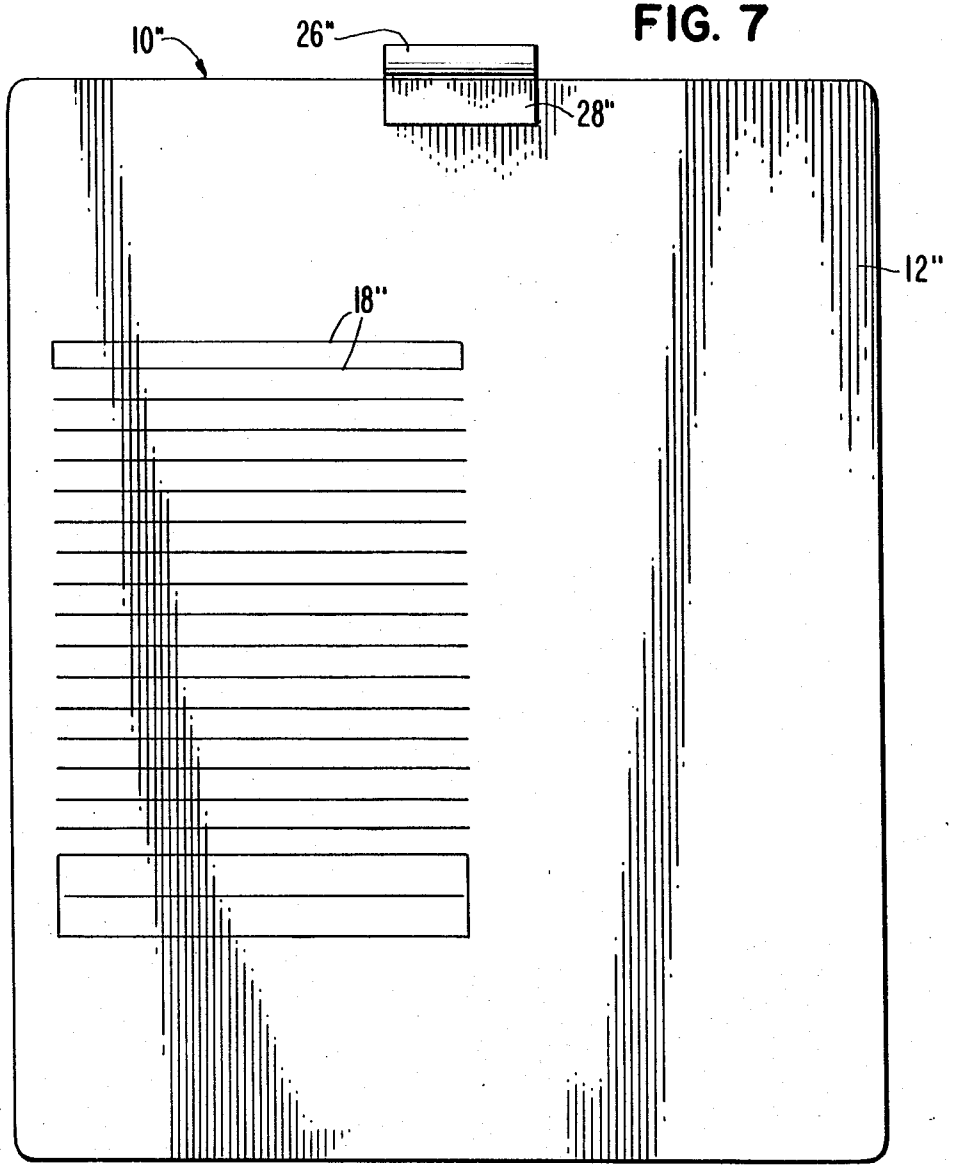
FIGS. 6 and 7 are perspective and rear views respectively of another alternate embodiment of the present invention.
Figure 6:
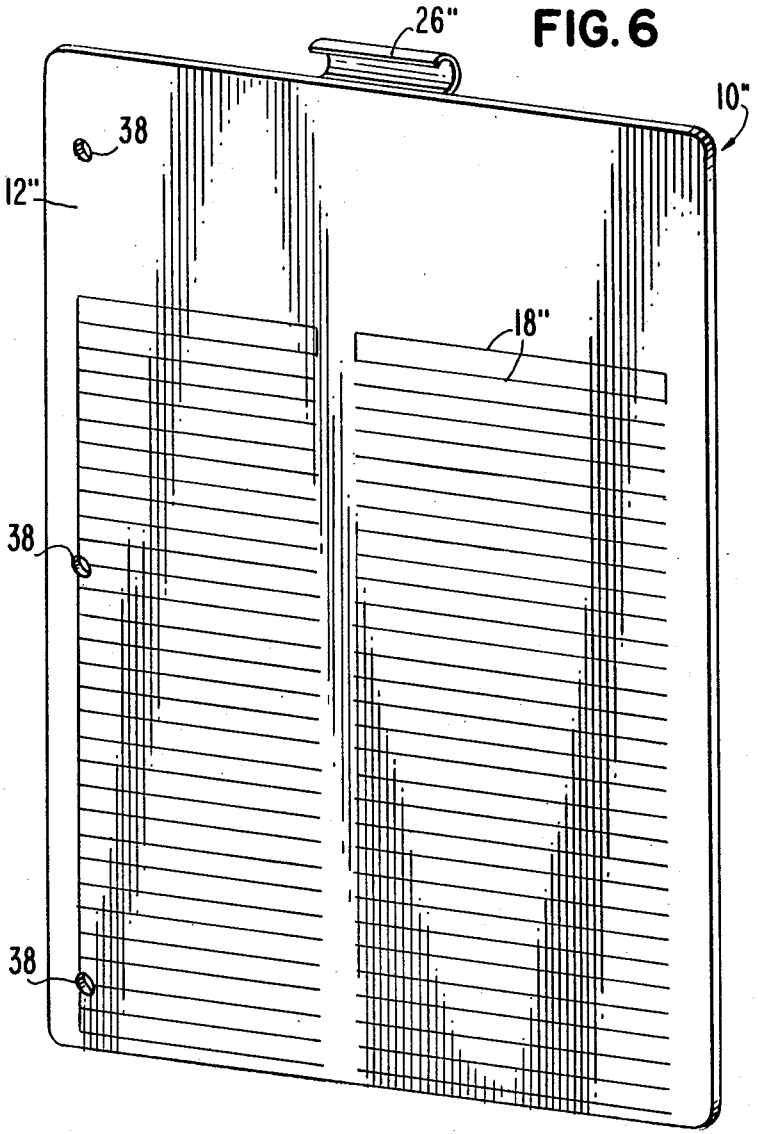

Referring to FIGS. 6 and 7, there is shown another embodiment of a bookmarking device generally indicated by reference numeral 10''. Structure of this embodiment which is the same as the other embodiments will be indicated by the same reference numerals, but with a double prime marking. In this embodiment the device 10'' has a configuration corresponding to that of a page divider of the loose-leaf type with the longitudinal edges thereof formed with perforations 38 which facilitate its releasable retention in a suitable binder therefor. In other respects the construction and printed indicia are comparable to that described in conjunction with the previously described embodiment.

Accordingly, there is provided an improved educational method which includes the steps of providing a bookmarker device which is sized to serve as a removable/replaceable page locator; providing printed indicia on the bookmarker which facilitate the recording and compiling of words and notes from a book; providing the bookmarker device with a surface which can have indicia recorded thereon by a writing instrument and easily removed therefrom for reuse; and providing a writing instrument retaining clip attached to the bookmarker device which releasably holds the writing instrument to be used for recording indicia.

Certain changes may be made in the above described educational bookmarker device, clip and method without departing from the scope of the present invention. It is intended that the matter contained in the description above and shown in the accompanying drawings shall be interpreted as illustrative and not in a limiting sense.

What is claimed is:

1. A reusable educational bookmarker device comprising:

a thin sheet assembly having a predetermined size which can serve as a removable replaceable locator for text material;

said sheet assembly being made of a smooth body of plastic material and including printed indicia on at least one surface thereof which facilitate recording and compilation of information from the text;

said recording surface being defined by smooth clear plastic surface such that recorded indicia can be recorded and erased therefrom, thereby allowing said bookmarker device to be reused;

said printed indicia facilitate recording and compilation of words and/or notes from the text to be read; and clip means attached to said sheet assembly for resiliently and releasably retaining a writing instrument used for recording the information on said recording surface;

said clip means includes a rigid attaching portion having energy deflectors comprising a plurality of rail-like projections projecting from and extending along one surface of said rigid attaching portion, which facilitate ultrasonic welding of said attaching portion to said plastic material of said sheet assembly, and a writing instrument retaining portion which releasable retains the writing instrument.

2. The educational bookmarker device of claim 1 further including a writing instrument for recording information on said recording surface and for detachable retention in said clip means.

3. The educational bookmarker device of claim 1 wherein said recording surface includes at least one non-erasable recording portion upon which information can be permanently recorded.

4. The educational bookmarker device of claim 1 wherein said permanent indicia includes a plurality of lines for allowing sequential compilation of recorded information.

5. The educational bookmarker device of claim 1 wherein said retaining portion includes a configuration which yieldably expands upon insertion of a writing instrument so as to releasably retain the writing instrument therein.

6. A reusable educational bookmarker device comprising:

a thin sheet assembly having a predetermined size which can serve as a removable/replaceable locator for text material;

said sheet assembly being made of a smooth plastic body and including printed indicia on at least one recording surface thereof which facilitate recording and compilation of information from the text, said recording surface being defined by an overlaminated smooth clear plastic material such that recorded indica can be recorded and erased therefrom, thereby allowing said bookmarker device to be reused;

clip means fixedly attached to said plastic sheet assembly and having a resilient portion which allows snap-fitting of a writing instrument therein for detachably retaining the writing instrument used for recording the information on said recording surface, said clip means having a relatively rigid attaching portion with energy deflectors comprising a plurality of rail-like projections projecting from and extending along one surface of said rigid attaching portion for facilitating ultrasonic welding of said clip means to said plastic sheet assembly;

said printed indicia being printed on said body to facilitate recording and compilation of words and/or notes from the text being read; and said recording surface includes at least one non-erasable recording portion made of a strip material upon which information can be permanently recorded, said strip material being secured to said plastic sheet assembly.

* * * * *